United States Patent [19]

Ketterer

[11] 4,299,181

[45] Nov. 10, 1981

[54] BOBBIN THREAD TENSION DEVICE

[75] Inventor: Stanley J. Ketterer, Jamesburg, N.J.

[73] Assignee: The Singer Company, Stamford, Conn.

[21] Appl. No.: 100,760

[22] Filed: Dec. 6, 1979

[51] Int. Cl.[3] ..... D05B 57/14; D05B 57/26

[52] U.S. Cl. ..... 112/184; 112/229; 112/231

[58] Field of Search ..... 112/181, 184, 228, 229, 112/231, 233

[56] References Cited

U.S. PATENT DOCUMENTS

| | | | |
|---|---|---|---|
| 2,098,270 | 11/1937 | Wood | 112/233 |
| 2,488,052 | 11/1949 | Casas Robert | 112/233 |
| 2,693,565 | 9/1952 | Ketterer | 112/184 |
| 2,851,977 | 9/1958 | Spaine | 112/231 |

FOREIGN PATENT DOCUMENTS

| | | | |
|---|---|---|---|
| 2433797 | 1/1976 | Fed. Rep. of Germany | 112/229 |
| 2650352 | 4/1978 | Fed. Rep. of Germany | 112/231 |
| 787233 | 12/1957 | United Kingdom | 112/233 |

*Primary Examiner*—Wm. Carter Reynolds
*Attorney, Agent, or Firm*—William V. Ebs; Robert E. Smith; Edward L. Bell

[57] ABSTRACT

A bobbin thread tensioning device on a bobbin case is provided with a pair of bobbin thread accepting members, one of which is biased toward the other by an adjustable spring. The thread accepting members are disposed relative to each other and with respect to a rotatable hook to assure seizure of the bobbin thread by the hook beak.

1 Claim, 12 Drawing Figures

BOBBIN THREAD TENSION DEVICE

BACKGROUND OF THE INVENTION

1. Field of the Invention:

The invention relates to bobbin thread tensioning devices for use in lockstitch sewing machines.

2. Description of the Prior Art:

The present invention is an improvement upon a bobbin thread tensioning device of the kind disclosed in U.S. Pat. No. 3,693,565 of Stanley J. Ketterer, for use in a lockstitch sewing machine wherein thread extends from a bobbin spool through the tension device at the peripheral surface of a bobbin case which supports the spool, passes under the hook, and finally emerges from an aperture in the throat plate to form stitches with needle thread in material being sewn. It is possible to set up such a machine to sew with a previously wound bobbin by manually drawing thread from the bobbin spool through the tensioning device, causing a length of the thread to be moved with the hook beak to a position partially around and partially under the hook as the hook is slowly rotated by the handwheel, and causing the hook beak with continued rotation of the handwheel to seize the needle thread and concatenate it around the bobbin thread such that the bobbin thread is moved by the needle thread wholly under the hook and up through the needle aperture in the throat plate. However, the construction of the tensioning device disclosed in said patent is such that bobbin thread exiting from the device isn't conveniently disposed for seizure by the hook beak. Unless the operator very carefully positions the loose end of the bobbin thread for seizure after pulling it through the tensioning device, the hook beak may fail to pick up and move the thread toward the underside of the bobbin case. Even with the bobbin thread properly positioned for seizure of the bobbin thread, seizure cannot be counted upon unless the hook beak is machined to close tolerances such as to cause it to enter a loop of bobbin thread. Furthermore, the construction of the tensioning device of the aforementioned patent requires removal of the bobbin case from the hook whenever bobbin thread tension is to be adjusted.

SUMMARY OF THE INVENTION

A bobbin thread tensioning device is constructed according to the invention to assure the seizure of bobbin thread by a hook beak and movement into a position under the hook when the machine is being set up for sewing. The bobbin thread tensioning device mounts on a bobbin case and includes a pair of thread accepting members one of which is spring biased toward the other to apply tension to thread between the two. Such device further includes means accessible from above the bobbin case for adjusting the spring force to change thread tension. The thread accepting members are disposed to cause bobbin thread to exit from below and radially inwardly from the path of the advancing end of the hook beak during rotation of the hook, and a thread guard is provided on the device to engage the exiting bobbin thread above and radially beyond the advancing end of the hook beak such that bobbin thread exiting from said members and engaging the thread guard is positioned for seizure by the hook beak.

DESCRIPTION OF THE PREFERRED EMBODIMENT

Figure 1:
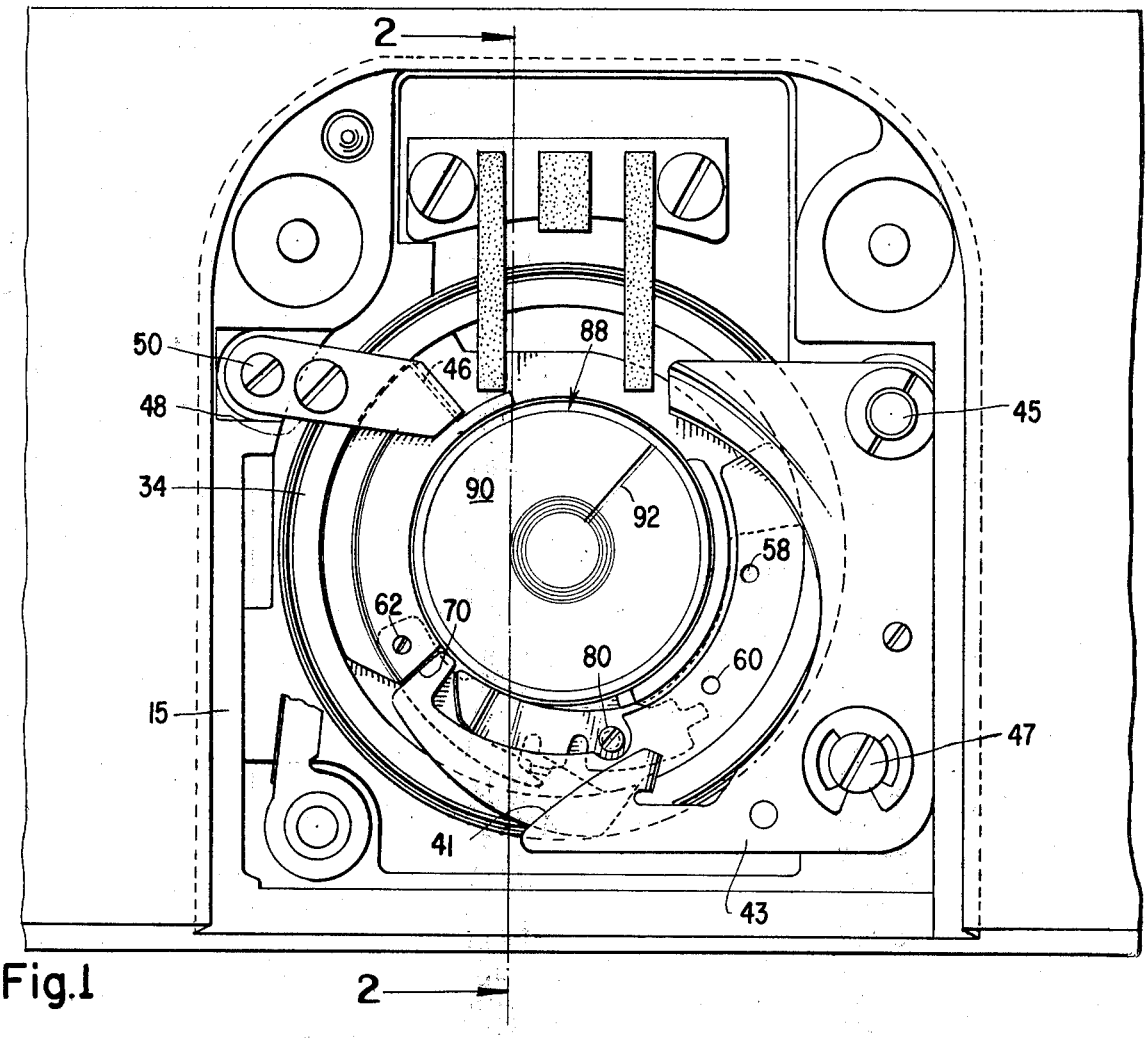
FIG. 1 is a top plan view of a rotary hook, and a bobbin case including the bobbin thread tensioning device of the invention.
Figure 2:
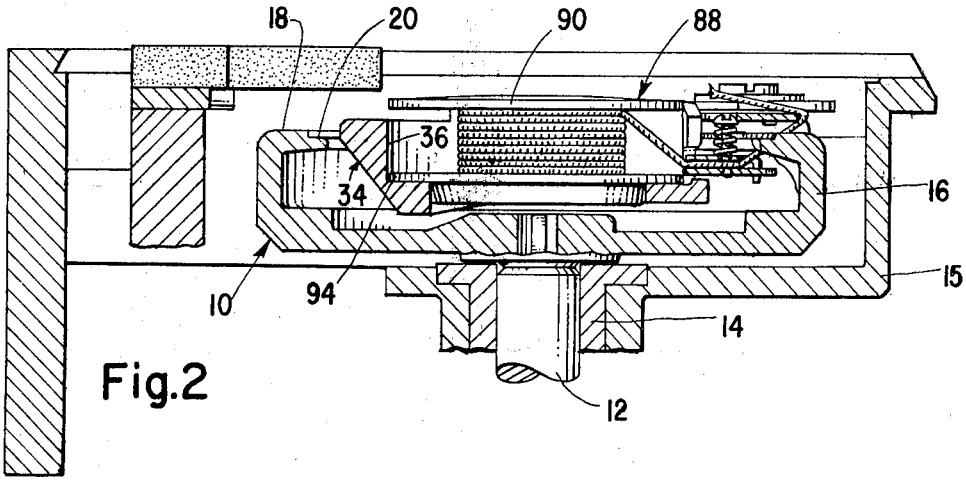
FIG. 2 is a sectional view taken on the plane of the line 2—2 of FIG. 1.
Figure 3:
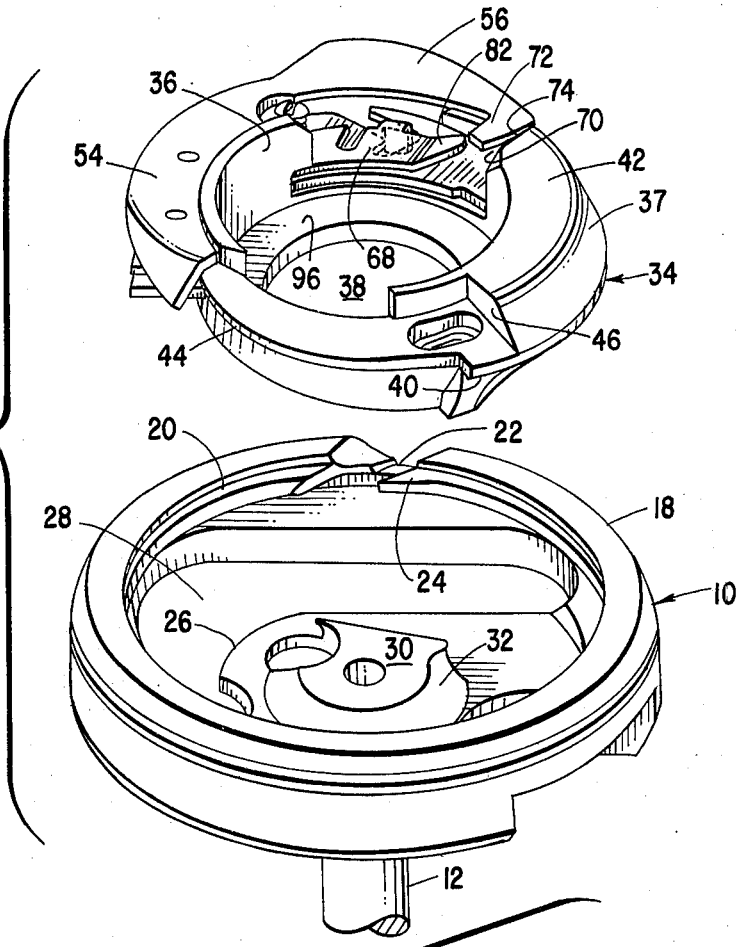
FIG. 3 is an exploded perspective view of the bobbin case.
Figure 4:
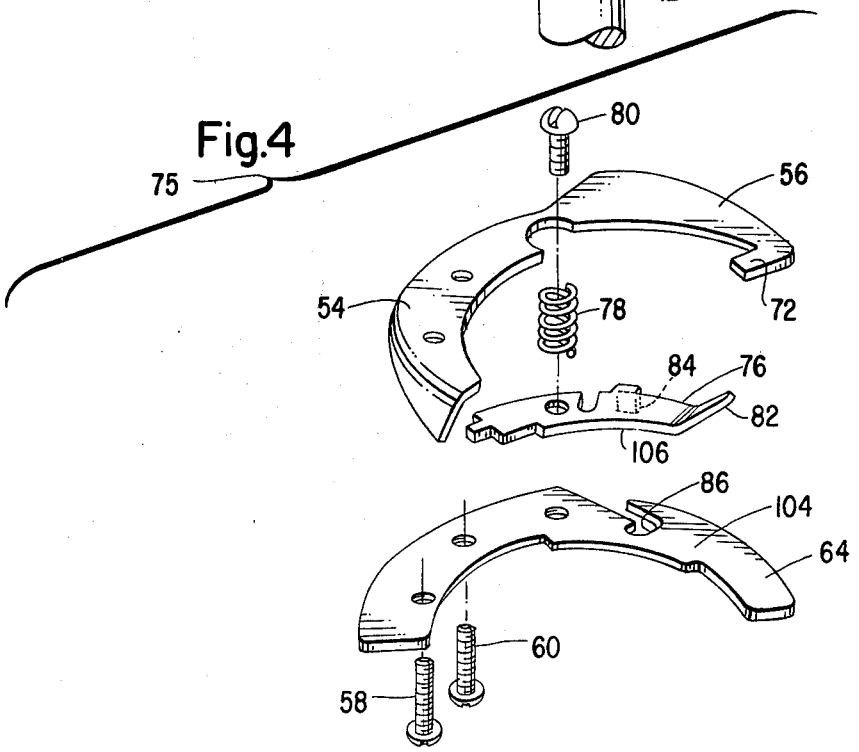
FIG. 4 is an exploded perspective view of the bobbin thread tensioning device of the invention.

Referring to the drawings, reference character 10 designates a hook for use in a lockstitch sewing machine of the type shown in U.S. Pat. No. 2,862,468 of R. E. Johnson issued Dec. 2, 1958 and assigned to The Singer Company. The hook is integral with a shaft 12 which mounts in a bushing 14 carried in the bed 15 of the machine, and rotates the hook during operation of the machine.

As shown, the hook 10 has an upwardly open cup-shaped form and includes a rim 16 with an inwardly extending top lip 18 and a bearing shoulder 20. A lateral opening 22 in the rim forms a thread loop seizing hook beak 24. The cup-shaped rotary hook 10 includes a base 26 formed internally with an annular through recess 28 a portion of which provides clearance for the tip of the needle 29 of the machine. The annular recess 28 isolates a raised annular boss 30 at the center of the base. A large segment at the edge of the boss 30 is chamfered as at 32 and a smaller segment has a substantially square peripheral edge. The raised boss serves a function, such as described in the said U.S. Pat. No. 3,693,565, in pulling off and positioning bobbin thread during sewing. Preferably the rotary hook 10 partakes of two revolutions during each cycle of endwise reciprocation of the needle 29 which passes through a needle aperture 31 in the throat plate 33 of the machine to cooperate with the hook in the formation of stitches.

Constrained within the cup-shaped rotary hook is a bobbin case generally indicated at 34. The bobbin case is formed with an upwardly open bobbin accommodating cavity 36 defined by a bobbin restraining ring 37 through the bottom of which there extends an aperture 38. The bobbin case ring is formed with a bearing flange 40 which rests upon the bearing shoulder 20 of the rotary hook and is constrained radially against lip 18. The ring 37 includes a cut-out top surface portion 42 which is cut back at the periphery, as at 44, to provide clearance for the path of needle reciprocation between the bobbin case and rotary hook. A ledge 46 at one end of cut-out top surface portion 42 is engageable with a rotation restraining element 48 secured by a screw 50 to a machine bed 15. For additional restraint of the bobbin case within the rotary hook a rotation restraining arm 41 extending from a bar plate 43 secured to bed 15 by screws 45 and 47 is provided.

A peripheral marginal portion 52 of the bobbin case ring 37 is formed to receive the support arm 54 of a thread guard 56 integral therewith. The support arm 54 is secured to the bobbin case ring by screws 58 and 60 which with an additional screw 62 also secure a platelike member 64 to a flattened undersurface 66 of the ring. The ring 37 is formed with a radial opening 68 which is spanned by thread guard 56 except for a thread receiving slot 70 between a radially inwardly projecting hooked end portion 72 of the guard and bobbin case wall 74 at one end of opening 68.

Members 64 and 74 constitute a pair of thread accepting members of a bobbin thread tensioning device 75 according to the invention. One member 76 of the pair overlies the other member 64 as shown. The tensioning device 75 also includes spring means for biasing member 76 toward member 64. Such spring biasing means may take the form of a coil spring 78 as shown in the drawings, and be disposed as illustrated, that is under the head of a screw 80 extending through an opening in member 76 and threaded into member 64. Member 76 includes an upturned thread guiding end portion 82 adjacent radially inwardly projecting hooked end portion 72 of the guard and a depending thread retaining tab 84 which extends into a thread receiving slot 86 in member 64.

Freely rotatable in the bobbin accommodating cavity 36 of the bobbin case 34 is a bobbin generally indicated at 88. The bobbin includes a top flange 90 formed with an outwardly extending slot 92 skewed slightly from a true radial position on the top flange. A bottom flange 94 of the bobbin is supported on an annular bearing surface 96 of the bobbin case. Between the flanges 90 and 94 of the bobbin, a cylindrical thread holding hub 96 is provided.

Figure 5:
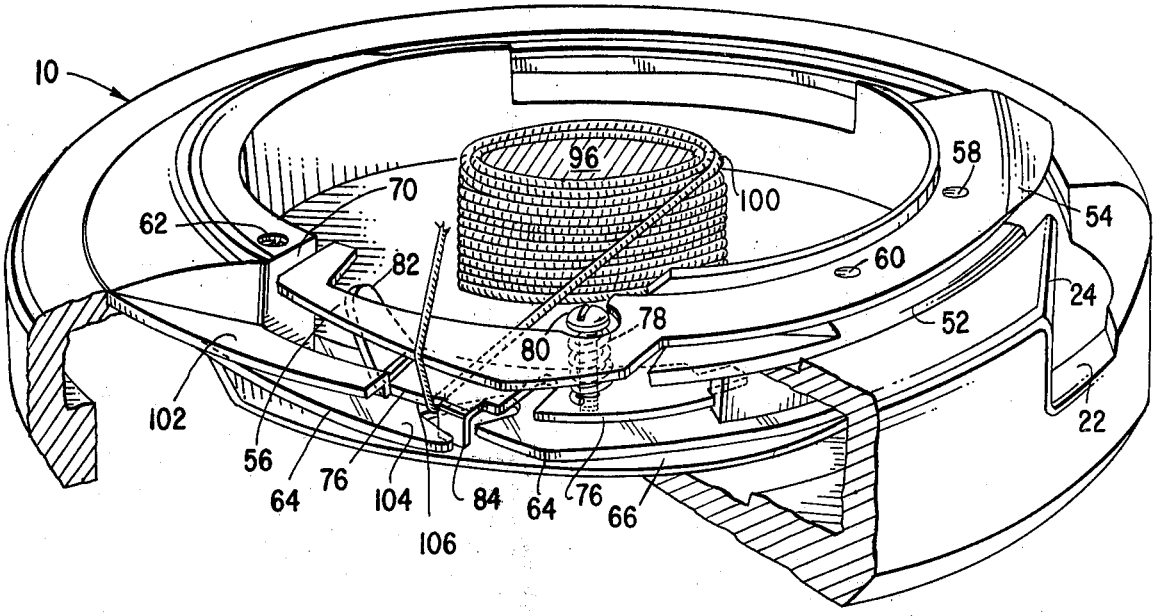
FIGS. 5 through 12 are perspective views illustrating the manner in which the tensioning device and hook cooperate as bobbin and needle threads are readied for sewing.
Figure 6:
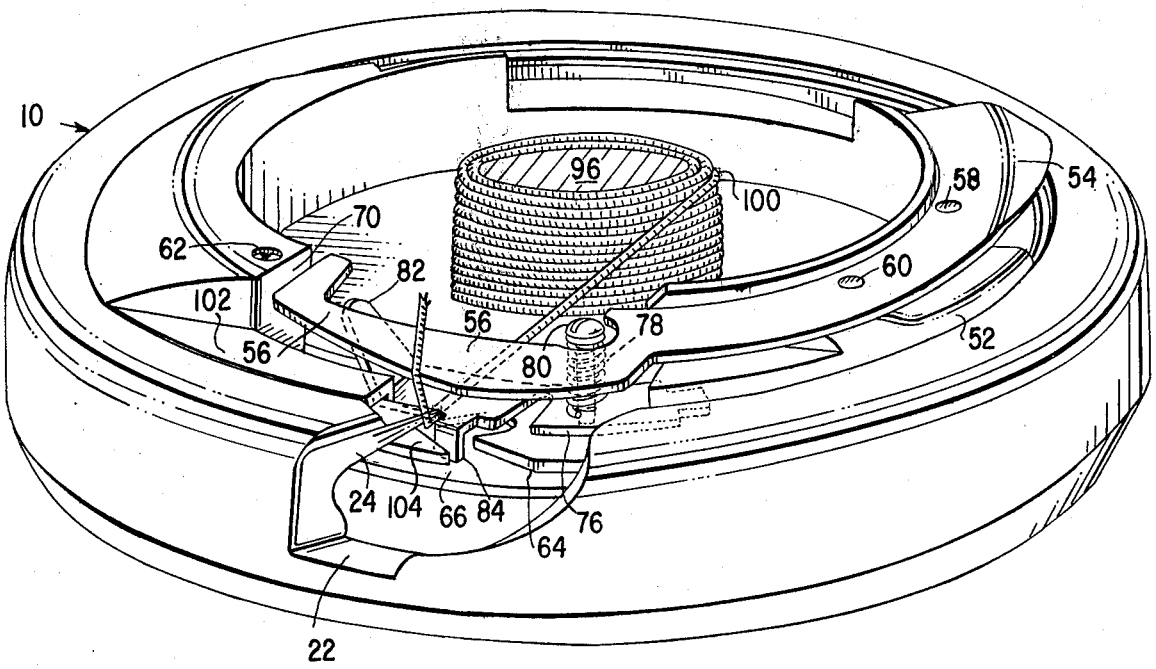

In preparation for sewing, an operator after threading needle 29 with needle thread 98 raises the needle to its highest position by rotating the handwheel (not shown) of the machine. A few inches of thread 100 are then drawn from the hub 96 of rotatable bobbin 88 and introduced by way of slot 70 and along a ridge 102 of the bobbin case into the tensioning device 75. The bobbin thread 100 is then pulled outwardly from the bobbin case and toward the right as viewed in FIG. 5 to cause the thread to be clamped between opposing flat surfaces 104 and 106 of members 64 and 76 respectively and to exit from the device substantially at tab 84. After the bobbin thread has been threaded through the tensioning device as described, the end length of the thread is held upwardly and against the thread guard 56 while the hook 10 is rotated with the handwheel of the machine and the hook beak 24 caused to seize the bobbin thread (FIG. 6).

Figure 7:
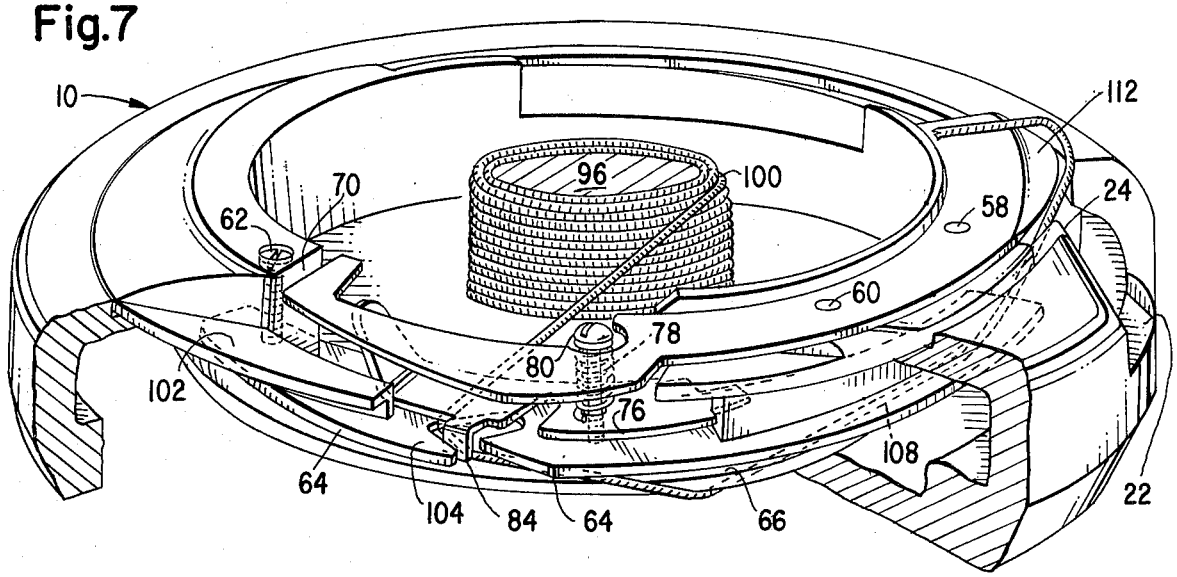

Thread tensioning member 64 is secured to bobbin case ring 37 to extend perpendicular to the axis of the bobbin 88 and the members 64 and 76 are disposed in the bobbin case to cause bobbin thread to exit from the tensioning device below and radially inwardly from the path of the advancing end of hook beak 24 during rotational movement of the hook 10, whereas the thread guard 56 is configured to engage the bobbin thread above and radially beyond the advancing end of the hook beak, the arrangement being such as to assure that the bobbin thread is in position for seizure by the hook. Once the bobbin thread has been seized by the hook beak 24, a lower limb 108 of the thread is moved by the hook to the underside of bobbin case (FIG. 7). As such movement continues the upper limb 110 slides off a canted end 112 of support arm causing the bobbin thread to fall off the hook beak.

Figure 8:
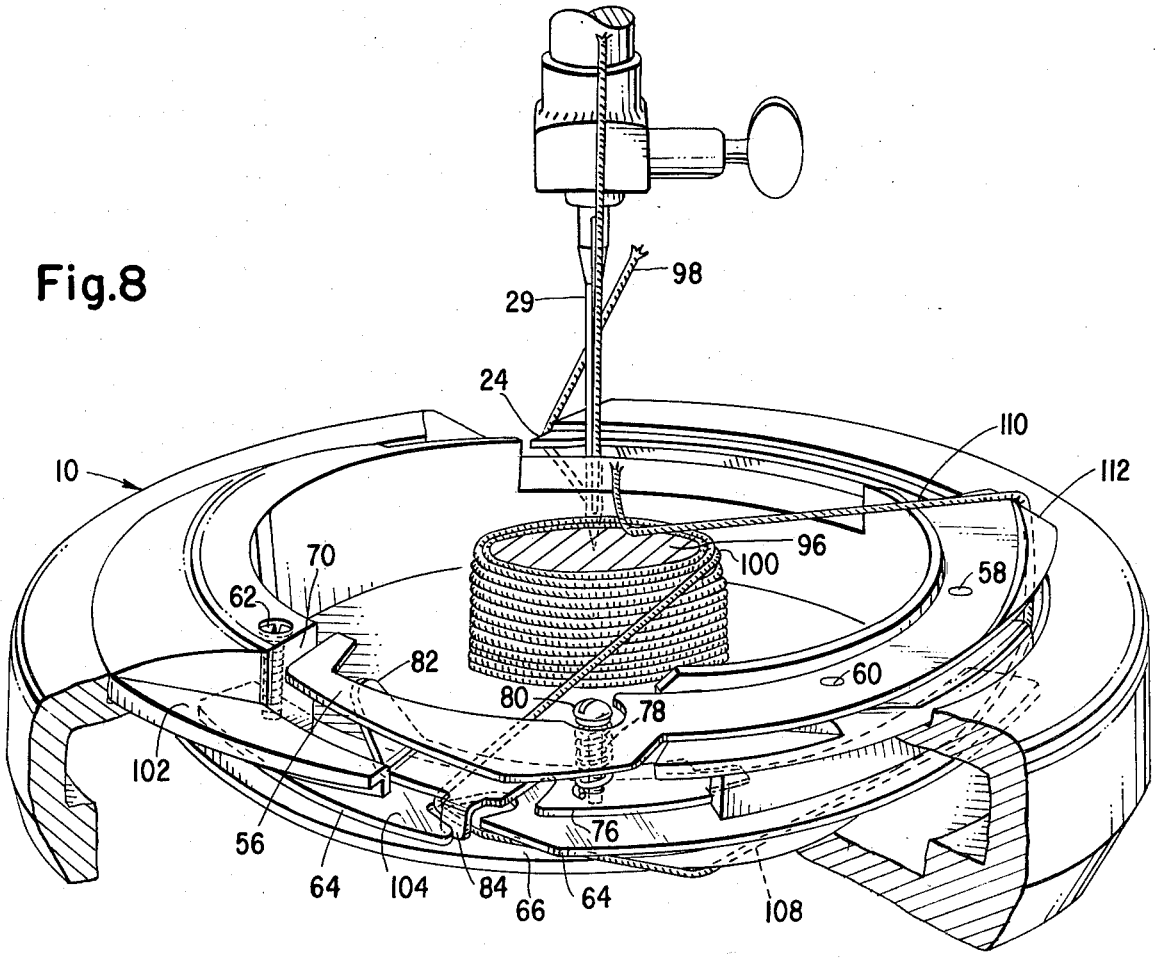
Figure 9:
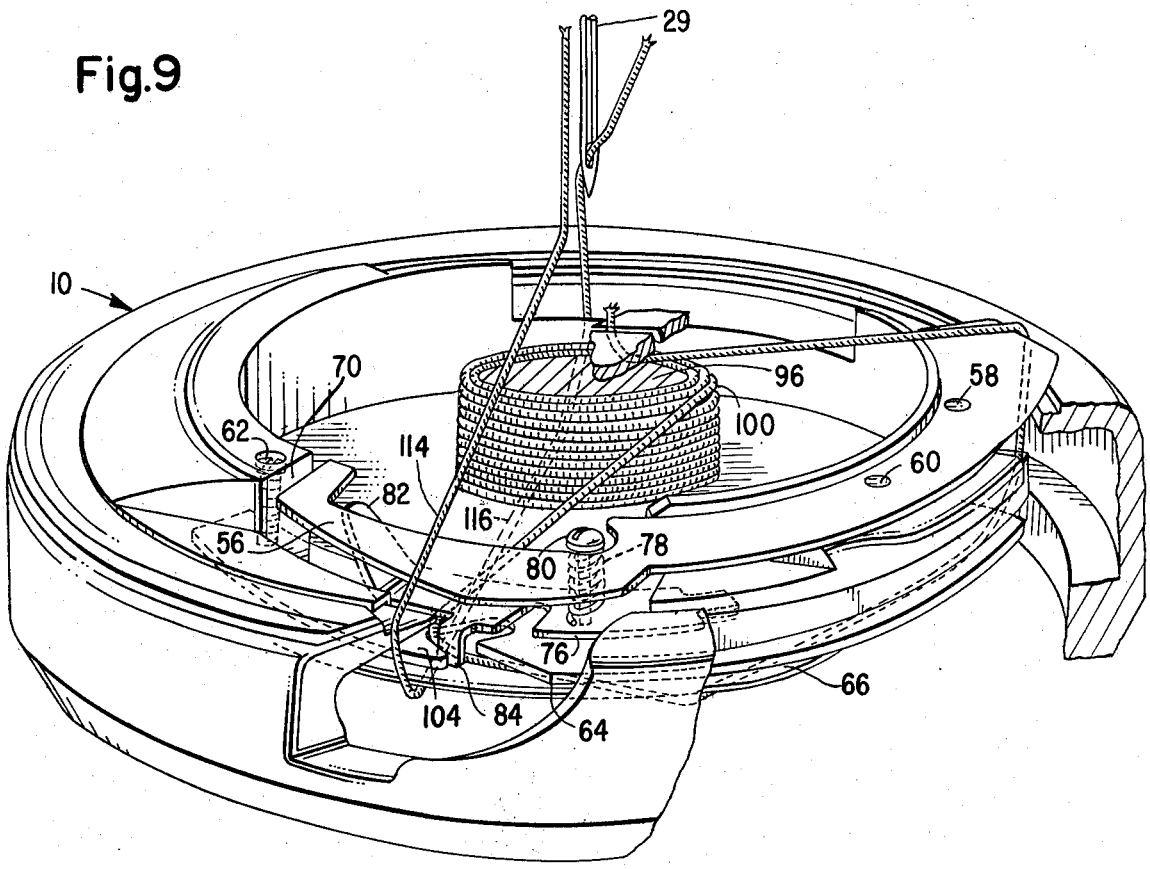
Figure 10:
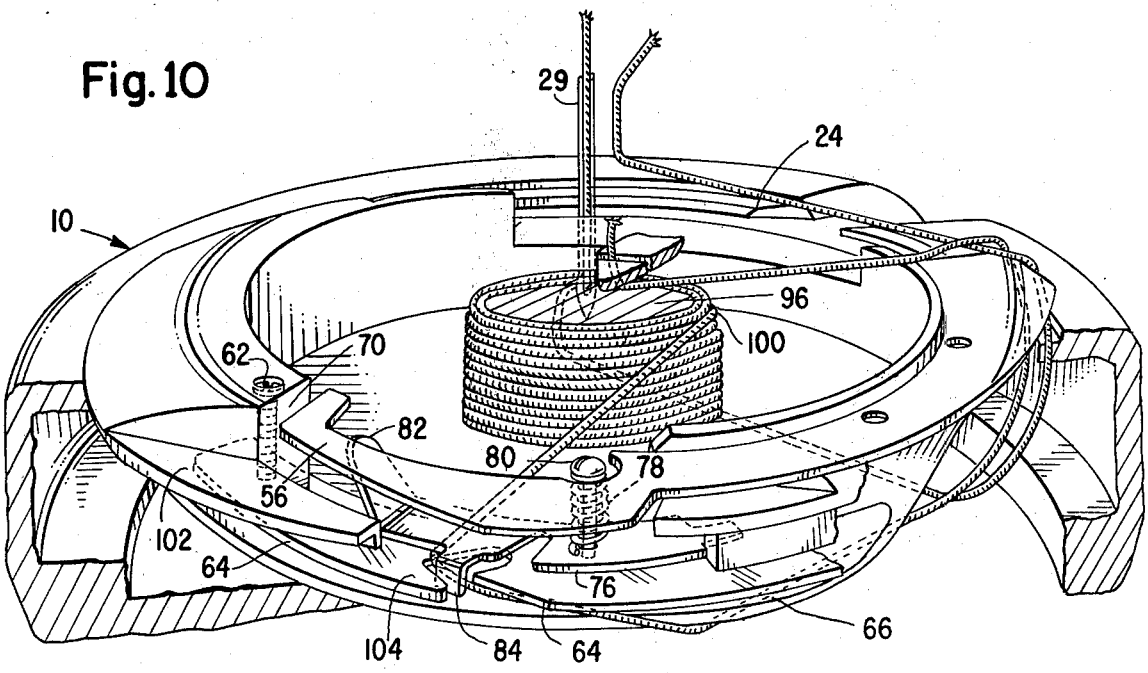
Figure 11:
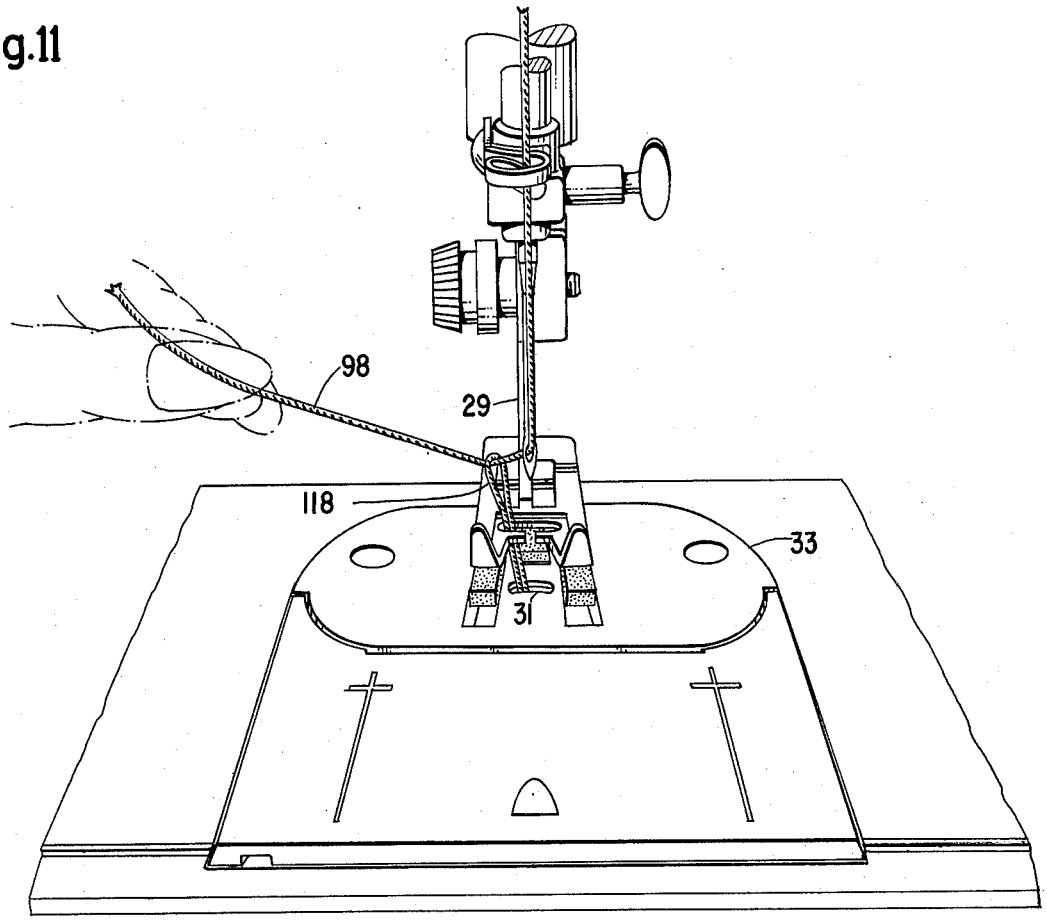
Figure 12:
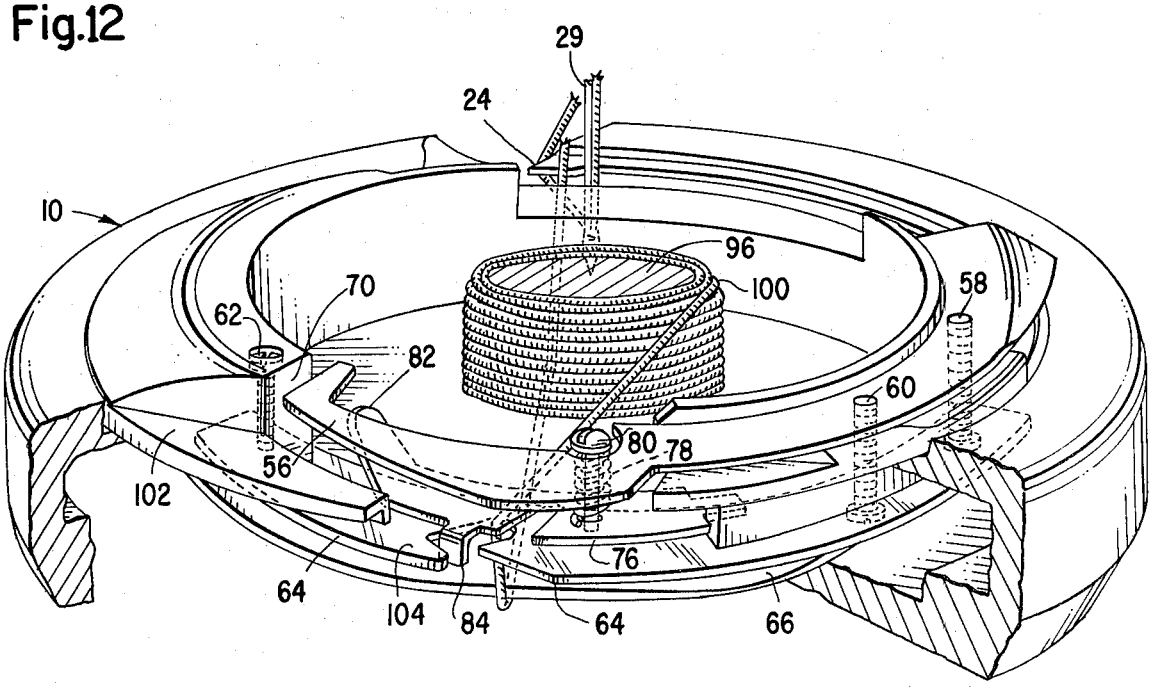

The needle thread 98 is held lightly by the operator while the needle 29 and hook beak 24 are suitably positioned by continued rotation of the handwheel for seizure of a loop of needle thread by the hook beak (FIG. 8). After the needle thread has been seized by the hook beak the hook moves an upper limb 114 of the loop of needle thread over the bobbin case 34 and a lower limb 116 under the bobbin case to concatenate the needle thread loop around the end portion of bobbin thread as described in the aforementioned U.S. Pat. No. 3,693,565 (see FIGS. 9 and 10). The bobbin thread 100 is drawn by the needle thread 98 completely under the bobbin case and is pulled up in a loop 118 by the needle thread through the needle aperture 31 in the throat plate (FIG. 11). In the process, the bobbin thread at the tensioning device is caused to move past tab 84 into the end of thread receiving slot 86 which is substantially diametrically opposite the vertical position of aperture 31. After the loop 118 of bobbin thread has been undone the needle and bobbin threads are ready for sewing.

As mentioned hereinbefore, the tensioning device 75 includes spring means for biasing member 76 toward member 64, the spring means being shown as a coil spring 78 under the head of a screw 80 extending through an opening in member 76 and in threaded engagement with member 64. By adjusting screw 80, an operator may alter the compression of spring 80 to change the pressure exerted by the members 76 and 64 on bobbin thread in the tensioning device. The screw 80 is readily accessible from above the bobbin case 34 and is convenient to an operator desiring to select a bobbin thread tension particularly suited for the work at hand.

It is to be understood that the present disclosure relates to a preferred embodiment of the invention which is for purposes of illustration only and is not to be construed as a limitation of the invention. Numerous alterations and modifications of the structure herein disclosed will suggest themselves to those skilled in the art, and all such modifications and alterations which do not depart from the spirit and scope of the invention are intended to be included within the scope of the appended claims.

I claim:

1. A bobbin case for use in a lockstitch sewing machine, the bobbin case being supportable in a rotatable hook with a loop seizing beak and including a cavity within a constraining ring for a rotatable bobbin, the bobbin case also including: a pair of bobbin thread tensioning members on the ring with one of said members spring biased toward the other to apply tension to bobbin thread pulled between the two; and a thread guard which is secured to the bobbin ring; the thread tensioning members being disposed on the ring to cause bobbin thread pulled through the tensioning members from the bobbin for seizure by the hook beak to exit from the said members below and radially inwardly from the path of an advancing end of the hook beak during rotation of the hook, and the guard being engageable with bobbin thread above and radially beyond the advancing end of the hook beak such that bobbin thread exiting from said members and in engagement with the thread guard is positioned for seizure by the hook beak, said thread guard including a support arm with a canted end for removing bobbin thread from the hook beak after seizure thereof by the hook beak.

* * * * *